US009963930B1

(12) United States Patent
Reisender

(10) Patent No.: US 9,963,930 B1
(45) Date of Patent: May 8, 2018

(54) HIGH SECURITY ANTI-SPLASH SYSTEM CUFFING BOX

(71) Applicant: David Paul Reisender, Ellenville, NY (US)

(72) Inventor: David Paul Reisender, Ellenville, NY (US)

( * ) Notice: Subject to any disclaimer, the term of this patent is extended or adjusted under 35 U.S.C. 154(b) by 0 days. days.

(21) Appl. No.: 15/722,177

(22) Filed: Oct. 2, 2017

(51) Int. Cl.
*E06B 7/32* (2006.01)
*E05B 65/00* (2006.01)
*E05G 7/00* (2006.01)

(52) U.S. Cl.
CPC ..... *E06B 7/32* (2013.01); *E05B 65/0017* (2013.01); *E05G 7/00* (2013.01)

(58) Field of Classification Search
CPC ..... E06B 7/32; E06B 7/00; E06B 7/34; E05B 65/0017; E05B 65/08; E05G 7/00; E05C 7/00
USPC ..... 232/1 E, 19, 44, 43.1, 43.4, 43.5; 109/19, 67, 68; 49/68; 220/476, 478, 220/479
See application file for complete search history.

(56) References Cited

U.S. PATENT DOCUMENTS 5,921,191 A * 7/1999 Gabel ..... E05G 7/005 109/13
6,302,325 B1 10/2001 Alexander
6,378,769 B1 * 4/2002 Wolgamot ..... E06B 7/32 109/68
6,588,655 B2 * 7/2003 Stapleton, Jr. ..... E06B 7/32 109/68
6,651,876 B2 * 11/2003 Scott ..... E05B 65/0841 109/67
6,817,481 B2 11/2004 Alexander
9,016,558 B2 4/2015 Alexander

* cited by examiner

*Primary Examiner* — William Miller
(74) *Attorney, Agent, or Firm* — Dunlap Bennett & Ludwig PLLC

(57) ABSTRACT

A high security anti-splash cuffing box system is provided for enabling articles to pass through the access opening of a high security door or wall and for the safe hand cuffing of prisoners or detainees by personnel outside the cell. The system embodies a door frame assembly providing a sliding door movable between a locked engagement and an unlocked disengagement in a closed and an open condition relative to the access opening, while providing anti-slam functionality. A cuffing box providing an enclosure with 280-degree visibility is detachably connectable and securely engageable to the door frame assembly.

14 Claims, 4 Drawing Sheets

HIGH SECURITY ANTI-SPLASH SYSTEM CUFFING BOX

BACKGROUND OF THE INVENTION

The present invention relates to access opening closure devices and, more particularly, to an High Security access opening closure device for allowing prisoner handcuffing and articles to pass through the access opening of a high security door or wall.

Inmates constantly abuse the security flaws inherent in standard food passage openings, allowing them to physically assault personnel with hazardous bodily fluids, chemicals and weapons and otherwise seriously threatening personnel outside their cell.

The heavy, stainless steel food box currently used makes it difficult for many staff to safely attach, remove, and transport the heavy food box from cell to cell. Furthermore, the small interior space of current food boxes limits what can be safely delivered to the inmate inside the cell. Furthermore, the small interior space of current food boxes makes the safe handcuffing of a prisoner's hands inside the boxes interior almost impossible. Restrictive space inside current food boxes prohibits the use of larger insulated food trays, cups and other larger items that can be safely passed to inmates inside the cell by staff. Moreover, extremely limited visibility inside current food boxes inherently causes a dangerous situation for staff outside of the cell. Current high security food boxes also suffer from poorly designed heavy sideways sliding door locking and securing mechanisms that are not tamper proof which can result in serious security problems from prisoners.

As can be seen, there is a need for a high security anti-splash system cuffing box that allows law enforcement personnel and military personnel to safely handcuffing prisoners inside the boxes interior while allowing full view of the prisoner hands being cuffed by personnel outside the cell. Additionally, the high security anti-splash system cuffing box enables larger articles to pass through the access opening of a high security door or wall. Wherein the high security anti-splash system cuffing box enables prisons, hospital psychiatric wards, detox medication distribution centers, military prisons, stockades, and detention facilities (and other facilities premised on isolating recipients) to safely pass articles through a secure structure without exposing enforcement personnel or hospital attendant to possible injury or battery by the prisoner or patient. Likewise, there is a need for a device that allows enforcement personnel or hospital attendants to place the inmate in hand restraints, like handcuffs, through the safety and security of the high security anti-splash cuffing box.

Some of the features of the new ANTI-SPLASH SYSTEM are:

1) The new and improved designed Anti-Splash System is constructed with highly tough and corrosion resistant 301 Stainless Steel.
2) The Anti-Splash System Frame section incorporates only one security lock to lower costs.
3) The Anti-Splash System Features a full "280 Degree" view inside the Box portion to increase the safety and security of personnel outside the cell.
4) The Anti-Splash System now incorporates a lighter removable Box system than any previously offered systems.
5) The Anti-Splash System' design features a new positive "Frame to Box Mating System" that seals and minimizes any gapes between the frame and box, such "mating" of box to frame prevents hazardous liquids from leaking out of the box sides and down the outside of the cell door.
6) There is a major increase in the usable interior space of the Anti-Splash Box without a major increase in footprint size. This usable interior space greatly increases the functionality and versatility of the Anti-Splash System Box.
7) The Anti-Splash "Frame System" that attaches to the cell door now incorporates a "High Security—Anti Tamper" door locking system.
8) The Anti-Splash System also featuring an extremely strong, batter-resistant polycarbonate (Lexan) transparent shell enabling personnel outside the cell to have an unobstructed view inside the Anti-Splash Box interior. The more law enforcement personnel can see the safer they are!
9) The Anti-Splash System now features a vertical opening and closing stainless steel door which travels only ⅓ the distance to fully open or close the door as compared to older design side sliding door configurations.
10) The Anti-Splash System can easily be retrofitted to existing cell door food slots so as to replace antiquated food slot opening that are directly responsible for many of the serious assaults to personnel by prisoners outside the cell.
11) The new vertical opening and closing stainless steel door alleviates any possibility of "bending" the sliding door when opening or closing the cell door while the vertical sliding stainless steel door is in the open position (a problem commonly encountered with older style side sliding door designs).

SUMMARY OF THE INVENTION

In one aspect of the present invention, a high security anti-splash cuffing box system operably associated with an access opening of a secured structure includes a door frame assembly providing a back plate, a front plate, and a sliding door sandwiched between said back and front plates so as to be selectively movable between an open condition and a closed condition blocking the access opening; the sliding door extending from a first edge to an opposing second edge; the first edge providing door teeth; a sliding door locking plate providing plate teeth, wherein the sliding door locking plate is attached to the back plate so as to be selectively movable between an unlocked disengagement and a locked engagement of said door and plate teeth; the opposing door second edge may incorporate a crescent toothed configuration that mates against a crescent spring loaded anti-slam plate that controls and prevents the sliding door from closing via gravity once in the open position. Steel rails, one on each side of the first edge and second edge of door framing housing, prevents lock tempering, and a cuffing box providing an access frame adapted to detachably mount to the front plate, wherein the cuffing box including an enclosure communicating to the access opening, the enclosure defined on an upper portion and two opposing side portions by a transparent cover; and a transparent door pivotally movable between an open position and a closed position further defining the enclosure.

In another aspect of the present invention, the high security anti-splash cuffing box system operably associated with an access opening of a secured structure includes a door frame assembly providing a back plate, a front plate, and a sliding door sandwiched between said back and front plates so as to be selectively movable between an open condition and a closed condition blocking the access opening; a latch slot provided by the front plate; a front plate opening provided by the front plate, wherein the front plate opening is generally coextensive with the access opening; four pin slots along a periphery of the front plate opening; the sliding door extending from a first edge to an opposing second edge; a sliding door pin near each lower corner of the sliding door, wherein two of the four sliding door pins slide into two of the four pin slots in both the open and the closed condition, respectively; the first edge providing door teeth; a first region provided by the front plate adjacent the access opening, wherein an anti-slam spring plate is disposed; a sliding door locking plate providing plate teeth, wherein the sliding door locking plate is attached to the back plate so as to be selectively movable between an unlocked disengagement and a locked engagement of said door and plate teeth; a sliding door handle extending from an upper portion of the sliding door and away from the access door; two anti-tamper notches provided by the sliding door; and two anti-tamper bars disposed in the anti-tamper notches adjacent the locked engagement; and anti-slam door crescent teeth providing along the second edge; the anti-slam spring plate providing anti-slam crescent plate teeth biased against the second edge so that when the anti-slam crescent door teeth and the anti-slam plate Crescent teeth engage, the sliding door is prevented from slamming to the closed position; at least two spring slot provided by the anti-slam spring plate; a spring housed in each spring slot for biasing said anti-slam plate crescent teeth; at least one oversized fastener hole provided by the anti-slam plate; and a fastener connected to the back plate engaging each oversized fastener hole; and a cuffing box providing an access frame adapted to detachably mount to the front plate, wherein the cuffing box including an enclosure communicating to the access opening, the enclosure defined on an upper portion and two opposing side portions by a transparent cover; a tray top locking mechanism attached to the access frame, wherein the tray top locking mechanism provides a bolt movable between an unsecure disengagement and a secure engagement in the latch slot, wherein the sliding door handle provides a handle notch to accommodate a keyable portion of the tray top locking mechanism; and a transparent door pivotally movable between an open position and a closed position further defining the enclosure.

In yet another aspect of the present invention, the high security anti-splash cuffing box system operably associated with an access opening of a secured structure includes a door frame assembly includes a back plate, a front plate, and a sliding door sandwiched between said back and front plates so as to be selectively movable between an open condition and a closed condition blocking the access opening; a plurality of spaced apart mounting blocks connected to the front plate; each mounting block providing nipple-shaped mating surface; and a cuffing box providing an access frame defining a box opening coextensive with the access opening; and a plurality of nipple-shaped lock tabs extending from the access frame into the box opening, each nipple-shaped lock tab spaced apart to align with one of the plurality of spaced apart mounting blocks, wherein each mounting block provides a retainer mating surface extending farther than said nipple-shaped mating surface so that when one of the plurality of nipple-shaped lock tabs operably engages said nipple-shaped mating surface said retainer mating surface opposes relative movement of said one lock tab, wherein an enclosure communicating to the access opening, the enclosure defined on an enclosure frame covered along an upper portion and two opposing side portions by a transparent cover; and a transparent door pivotally movable between an open position and a closed position further defining the enclosure, and wherein a front latch plate attached to the attachment frame, the front latch plate providing a locking cavity; and a door locking mechanism connected to the transparent door; the door locking mechanism providing a front bolt selectively movable between an unlocked door disengagement and a locked door engagement with the front bolt engaging the locking cavity.

These and other features, aspects and advantages of the present invention will become better understood with reference to the following drawings, description and claims.

DETAILED DESCRIPTION OF THE INVENTION

Figure 1:
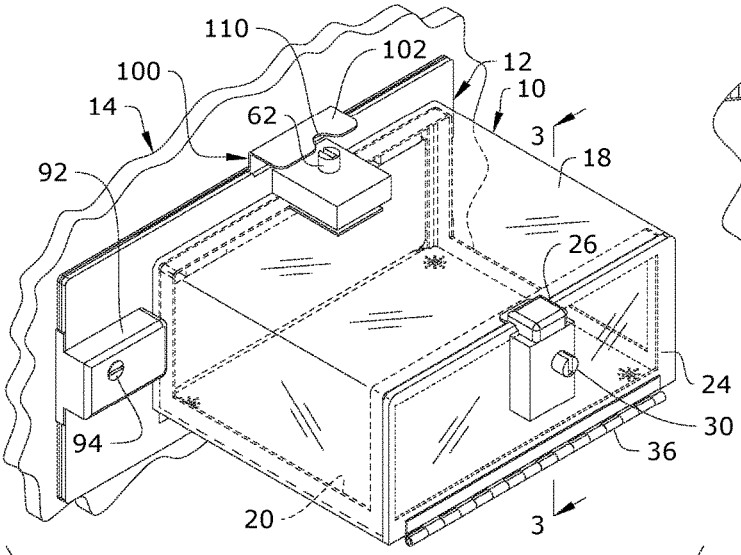
FIG. 1 is a perspective view of an exemplary embodiment of the present invention.
Figure 2:
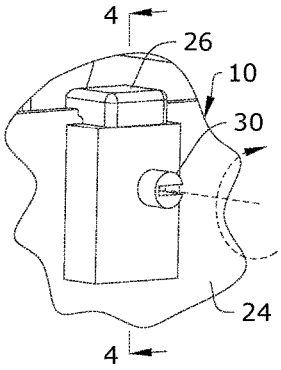
FIG. 2 is a detailed perspective view of an exemplary embodiment of the present invention, demonstrating lock turning.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a high security anti-splash cuffing box system enabling articles to pass through the access opening of a high security door or wall, while providing full view high visibility of the prisoner hands being cuffed inside the box by personnel outside the cell to ensure personnel's safety while handcuffing prisoners. The system embodies a door frame assembly providing a sliding door movable between a locked engagement and an unlocked disengagement in a closed and an open condition relative to the access opening, while providing anti-slam functionality. A cuffing box providing an enclosure with 280-degree visibility is detachably connectable and securely engageable to the door frame assembly.

Referring to FIGS. 1 through 22, the present invention may include a high security anti-splash cuffing box 10 that is much lighter than current food boxes, through utilizing lighter polycarbonates in place of heavy stainless steels, and thereby enabling personnel to more readily transport the removable cuffing box from cell to cell. The present invention also enables higher visibility (a full 280 degree) inside the cuffing box 10 by personnel outside of the cell which enhances their security and safety by allowing personnel to see prisoners' hands are free of weapons, such as bio hazards. The present invention also provides a larger removable cuffing box 10 interior, facilitating the passing of larger objects to inmates inside the cell including popular insulated food trays and large beverage cups used in many facilities. The present invention incorporates a high security sliding door locking mechanism 94 for the sliding door 100, assuring a secure locked sliding door 100 enhancing facility security. The present invention also utilizes gravity to assists personnel in closing the sliding door 100 and further hampering inmates from resisting the closing of the cuffing slot door. The present invention also provides a removable detachable connection for operably associating the cuffing box 10 to various access openings 16 during use over an estimated service life of fifty years.

Referring to FIGS. 12-16, the high security anti-splash cuffing box 10 provides a door frame assembly 12 for circumscribing an access opening 16 of a cell structure 14, the cell structure 14 being either a door or a wall. The door frame assembly 12 comprises back and front stainless steel plates, 40 and 48 respectively, each providing respective openings 42 and 50 dimensioned to match the access opening 12. The back and front plates, 40 and 48 may sandwich a spacer plate 44 having a spring plate cavity 46. The back and front plates, 40 and 48 and the sliding door 100 therebetween may be approximately 24" long, 12" high, ¼" width and sandwiched together via welds. The door frame assembly 12 may be mounted to the cell structure 14 via stainless steel screw/bolts.

On a first peripheral edge, the front plate 48 may provide a first region 58 for an anti-slam spring cover plate 68. Along an opposing second peripheral edge, the front plate 48 may provide a locking mechanism notch 52 dimensioned and adapted so that a sliding door locking mechanism cover 92 may protrude through when the sliding door locking mechanism cover 92 is operatively associated with the sliding door locking mechanism 94 attached to the back plate 40 by way of an upper spacer plate 66 and a sliding door locking base plate 96 sandwiched by the front plate 48. The sliding door locking base plate 96 may provide a plurality of vertical teeth 98 along an inner edge thereof, facing the access opening 16.

Figure 14:
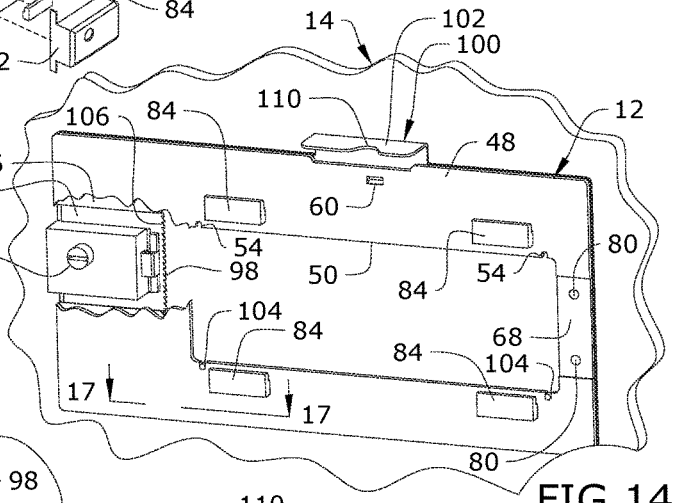
FIG. 14 is a front perspective partial-cutaway view of an exemplary embodiment of the door frame assembly of the present invention shown with sliding door lock in a locked engagement.
Figure 15:
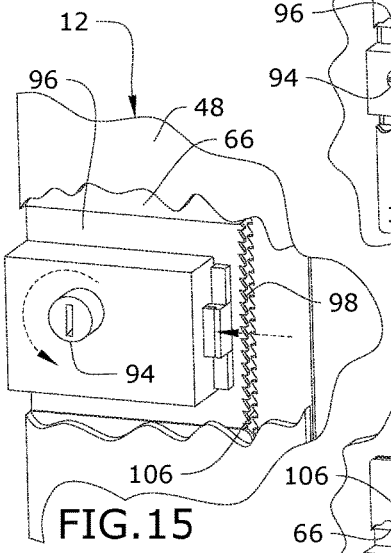
FIG. 15 is a detail front perspective partial-cutaway view of an exemplary embodiment of the door frame assembly of the present invention shown with sliding door lock in an unlocked disengagement.
Figure 17:
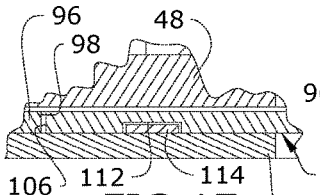
FIG. 17 is a detail section view of an exemplary embodiment of the present invention taken along line 17-17 in FIG. 14 demonstrating anti-tamper bar location, there is an identical anti-tamper bar located on the opposite side (right side) of the frame (not shown)
Figure 16:
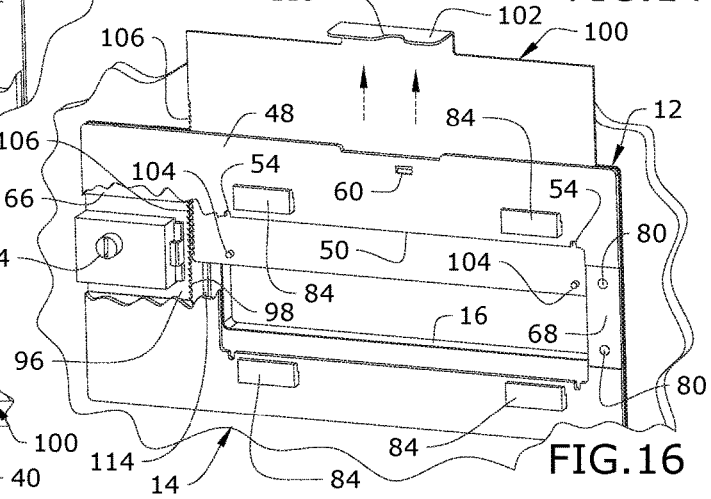
FIG. 16 is a front perspective partial-cutaway view of an exemplary embodiment of the door frame assembly of the present invention shown with sliding door opening.
Figure 18:
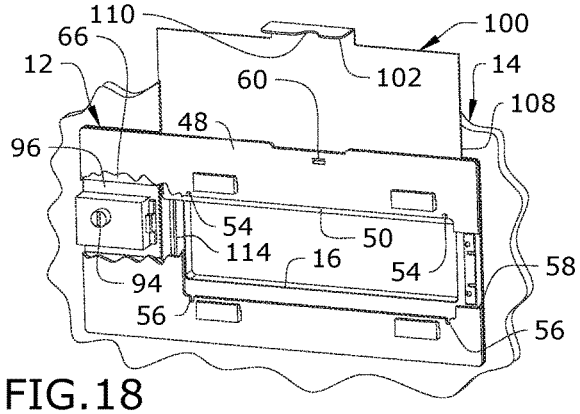
FIG. 18 is a front perspective partial-cutaway view of an exemplary embodiment of the door frame assembly of the present invention shown with sliding door in an open condition.

The sliding door 100 may be stainless steel dimensioned and adapted to slide between the back and front plates 40 and 48 when operatively associated so the sliding door 100 moves between an open condition (FIG. 16) and a closed condition (FIG. 14). The sliding door 100 provides a handle 102 along an upper edge thereof for facilitating such movement, wherein the handle 102 extends perpendicularly from the sliding door 100 away from the structure 14. The handle 102 may provide a handle notch 110 along a distal edge thereof. A lateral edge of the sliding door 100 provides sliding door teeth 106 dimensioned and adapted to be selectively engaged and disengaged by the vertical teeth 98 between a sliding door locked engagement and sliding door unlocked disengagement when the sliding door locking mechanism 94 selectively moves between a locked position (FIG. 14) and an unlocked position (FIG. 15) through manipulation of a key (not shown). The sliding door 100 may be moved to the closed condition by pushing down without the use of a key in the sliding door locking mechanism 94. The sliding door locking mechanism 94 may be paracentric keyed lock (1700 Series High Security or compatible). The sliding door 100 may provide an anti-tamper notch 112 for slidably receiving an anti-tamper bar 114 disposed adjacent the sliding door locked engagement. A second anti-tamper notch 112 for slidably receiving an anti-tamper bar 114 disposed adjacent the sliding door locked engagement are on both the left and right (not shown) sides.

Figure 13:
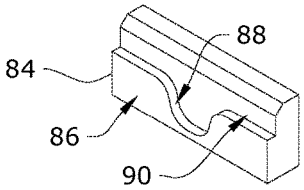
FIG. 13 is a perspective view of an exemplary embodiment of a mounting block of the present invention.

The sliding door 100 may provide a plurality of spaced apart mounting blocks 84 for mounting the cuffing box 10 to the door frame assembly 12. Each mounting blocks 84 may provide a front plate mating surface 86, a tray frame mating surface 88 and a forward tray retainer mating surface 90, as illustrated in FIG. 13. The tray frame mating surface 88 may provide a slot/protrusion formation dimensioned and adapted to operatively engage an access frame lock tab 38.

Figure 20:
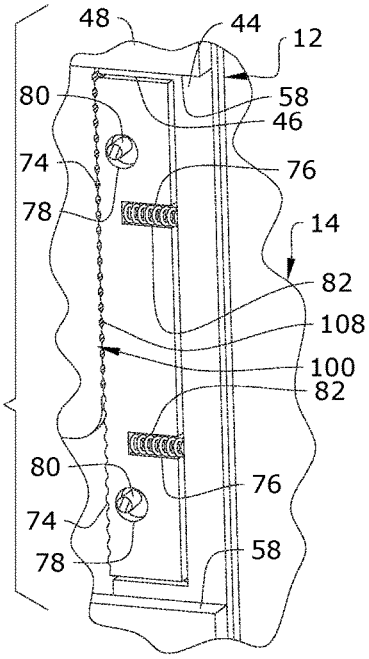
FIG. 20 is a detail front perspective partial-cutaway view of an exemplary embodiment of the door frame assembly of the present invention shown with sliding door in a partial closed condition and anti-slam crescent tooth plate in an exemplary anti-slam disengagement.
Figure 22:
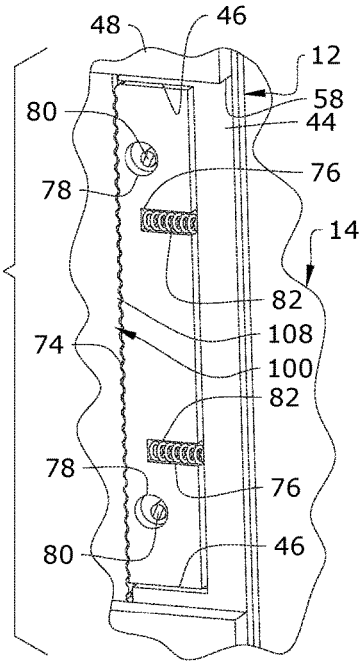
FIG. 22 is a detail front perspective partial-cutaway view of an exemplary embodiment of the door frame assembly of the present invention shown with sliding door in a partial closed configuration and the anti-slam crescent tooth plate in an exemplary anti-slam engagement.
Figure 21:
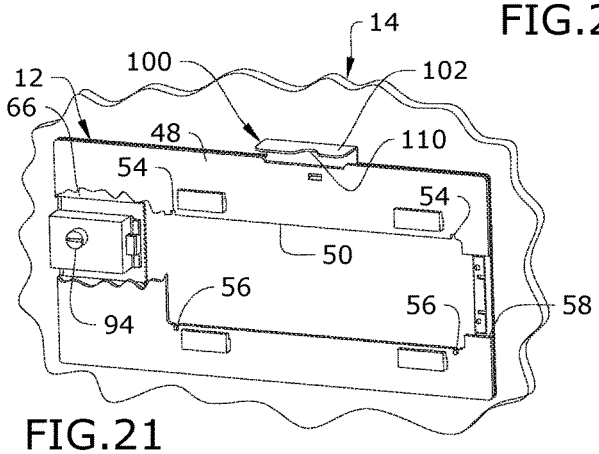
FIG. 21 is a front perspective partial-cutaway view of an exemplary embodiment of the door frame assembly of the present invention shown with sliding door in a closed condition.

Referring to FIGS. 18-22, on the opposing lateral edge of the sliding door 100 may be provided sliding door anti-slam plate crescent teeth 108 that are dimensioned and adapted to engage with anti-slam spring plate crescent teeth 74 of the anti-slam spring plate 72, as illustrated in FIG. 22. The sliding door 100 thus is movable between the anti-slam engagement of FIG. 22 and an anti-slam disengagement, as illustrated in FIG. 20. The anti-slam spring plate 72 may be disposed in the first region 58 and covered by cover plate 68. The anti-slam spring plate 72 may provide oversized fastener holes 78 for fastener retainers 80 as well as spring slots 76 for springs 82 to spring bias the anti-slam spring plate crescent teeth 74 in the direction of the sliding door anti-slam plate Crescent teeth 108, preventing slamming of the sliding door 100 and thus imposing a controlled movement toward the closed condition.

Figure 19:
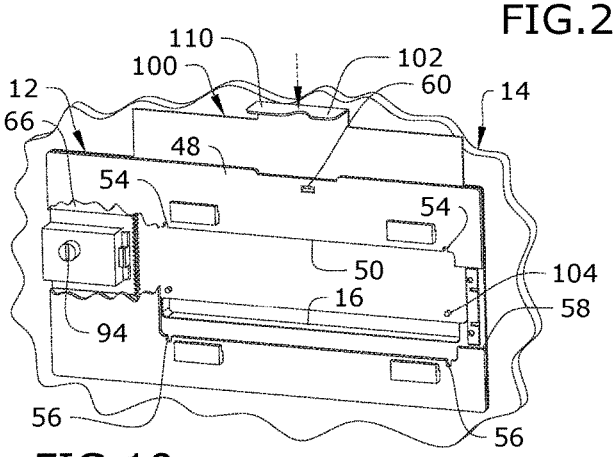
FIG. 19 is a front perspective partial-cutaway view of an exemplary embodiment of the door frame assembly of the present invention shown with sliding door in a partial closed condition.

Referring to FIG. 19, the sliding door 100 may provide a sliding door pin 104 near each lower corner thereof, wherein each sliding door pin 104 is dimensioned and adapted to slide into upper and lower pin slots 54 and 56, respectively, of the front plate 48 when the sliding door 100 is in the open and closed conditions, respectively.

Referring to FIGS. 6-11, the handle notch 110 is dimensioned and adapted to slidably receive a keyable portion of a tray top locking mechanism 62. The tray top locking mechanism 62 provides a bolt 64 selectively movable between a secure engagement unsecure disengagement with the front plate latch slot 60. Thereby controlling the opening and closing of the sliding door 100. The tray top locking mechanism 62 may be a paracentric keyed lock (1700 Series or compatible).

Figure 8:
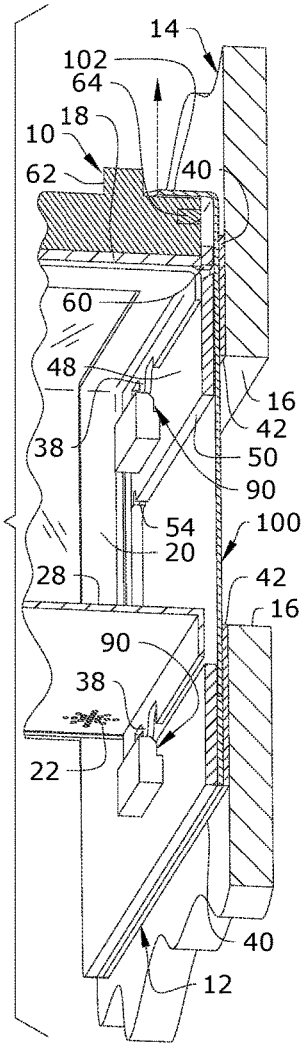
FIG. 8 is a cutaway perspective view of an exemplary embodiment of the present invention, showing a tray being vertically lifted off the mounting blocks.
Figure 9:
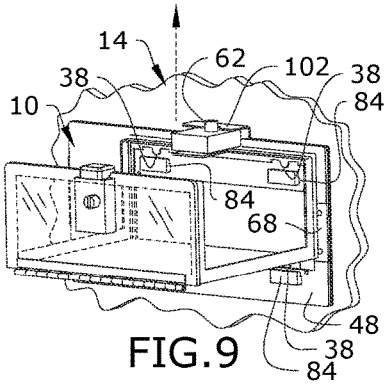
FIG. 9 is a perspective view of an exemplary embodiment of the present invention, showing the cuffing box being vertically lifted off the mounting blocks with the transparent cover omitted for clarity.
Figure 10:
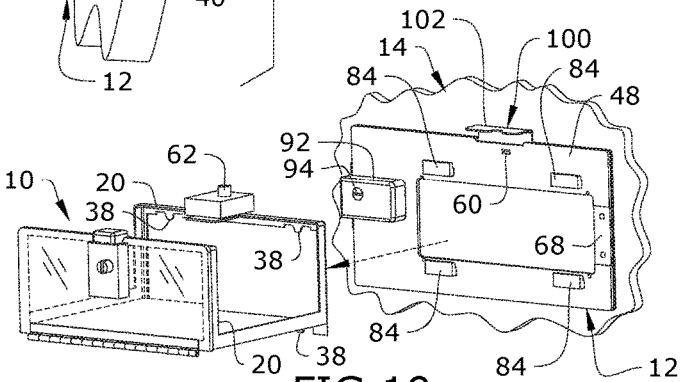
FIG. 10 is an exploded view of an exemplary embodiment of the present invention, showing the cuffing box being removed with the transparent cover omitted for clarity.
Figure 11:
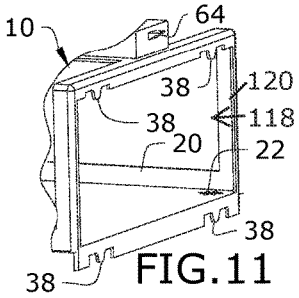
FIG. 11 is a rear detail perspective view of an exemplary embodiment of the present invention, showing demonstrating the slot/protrusion formations of the access frame lock tab.
Figure 12:
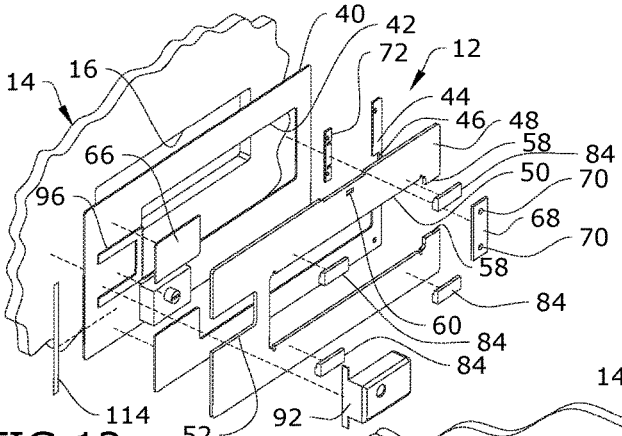
FIG. 12 is an exploded view of an exemplary embodiment of a door frame assembly of the present invention.

Referring to FIGS. 1-11, the cuffing box 10 provides a transparent cover 18 defining an enclosure 118 between an enclosure pan 28. The transparent cover 18 may be made of polycarbonate or the like, whereby the clear view inside the cuffing box enhances the personnel's safety and security by being able to see everything that's going on inside the enclosure 118 at all times and at all angles of view, decreasing the likelihood of the personnel being a victim of an inmate assault. The cuffing box 10 provides an access frame 120 defining a box opening 122 communicating with the enclosure 118, wherein the box opening 122 is dimensioned to operatively associate with the access opening 16 of the cell structure 14. The access frame 120 may provide lock tabs 38 protruding into the box opening 122, wherein each lock tab 38 provides a slot/protrusion formation dimensioned and adapted to operatively engage the tray frame mating surface 88 of an associated mounting block 84. The quick remove-attach cuffing box 10 may be removed first vertically from the mounting blocks 84, as illustrated in FIGS. 8 and 9, and then pulled away from the cell structure 14, as illustrated in FIG. 10, with attachment of the cuffing box 10 to the door frame assembly 12 happening in reverse.

Figure 3:
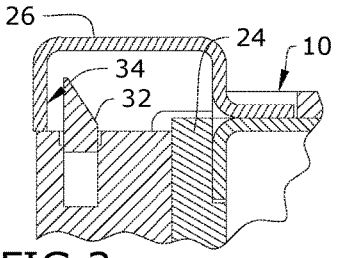
FIG. 3 is a section detail view of an exemplary embodiment of the present invention, taken along line 3-3 of FIG. 1.
Figure 4:
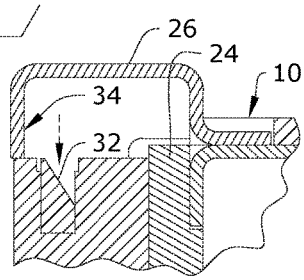
FIG. 4 is a section detail view of an exemplary embodiment of the present invention, taken along line 4-4 of FIG. 2.
Figure 5:
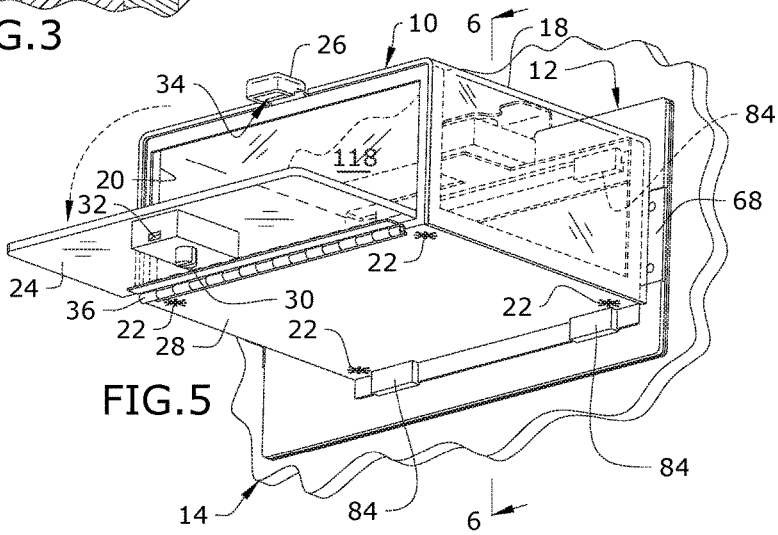
FIG. 5 is a bottom perspective view of an exemplary embodiment of the present invention, shown with the front transparent door in an open position.
Figure 6:
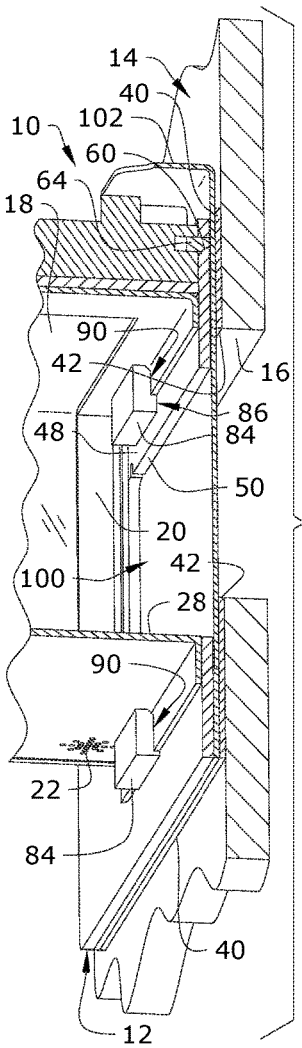
FIG. 6 is a cutaway perspective view of an exemplary embodiment of the present invention, taken along line 6-6 in FIG. 5, showing a latch of a tray top locking mechanism in a secured engagement.
Figure 7:
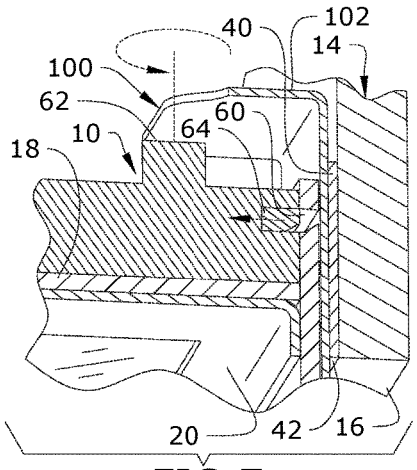
FIG. 7 is a detail cutaway perspective view of an exemplary embodiment of the present invention, showing said latch in an unsecured disengagement.

Referring to FIGS. 1-5, the access frame 120 may be joined to a tray enclosure frame 20, which in turn is joined to the enclosure pan 28 by welding via the weldment weep holes 22 or other joining methods. A transparent door 24 may be pivotal connected to the tray frame enclosure frame 20 via a pivot 36 so that the transparent door 24 moves between a closed position and an open position, wherein the open position provides access to the enclosure 118, as illustrated in FIG. 5. The transparent door 24 may be made of polycarbide or the like. A front latch plate 26 may connect a door locking mechanism 30 to the transparent door 24. The front latch plate 26 may provide a locking cavity 34 into which a bolt 32 of the door locking mechanism 30 may selectively slide in and out when positioned between a locked door engagement and an unlocked door engagement, as illustrated in FIGS. 3 and 4, respectively, thereby controlling the opening and closing of the transparent door 24. The door locking mechanism 30 may be a paracentric keyed lock (1700 Series High Security or compatible).

A method of using the present invention may include the following. The high security anti-splash cuffing box 10 disclosed above may be provided. A user may attach the access frame 120 to the door frame assembly 12, making the transparent door 24 the portal to the enclosure 118 of the cuffing box 10. After insuring that the sliding door 110 is in a locked engagement, the personnel outside the cell structure 14 places articles into the enclosure 118, securely closes and locks the transparent door 24, and then opens the sliding door 100 enabling the inmate inside the cell structure 14 to retrieve said articles. Thereby eliminating physical contact between the personnel and inmates and thus virtually eliminating the possibility of dangerous assault incidents. The high security anti-splash cuffing box also ensures 280 degree high visibility allowing full view of the prisoner hands being cuffed inside the box by personnel outside the cell, thereby allowing personnel to assure prisoners hands are free of weapons, or bio hazards which ensure personnel's safety while handcuffing prisoners The high security anti-splash cuffing box 10 can be moved from access opening 16 to access opening 16 enabling the use of one cuff box 10 to be used on many cell structures 14 that incorporate the door assembly frame 12. The high security anti-splash cuffing box 10 can easily retrofit existing cell door food slots. The high security anti-splash cuffing system will virtually eliminate violent assault incidents enable by antiquated food slot passages. The high security anti-splash cuffing system will save administrators money by lowering budget expenditures through the following: reduced costs in overtime to replace injured staff; reduced costs in medical treatment for staff and inmates; reduced costs in defending frivolous lawsuits initiated by inmates claiming injuries, rights violation, against staff, administration, and municipalities; and reduced costs in expensive investigations of assault incidents.

It should be understood, of course, that the foregoing relates to exemplary embodiments of the invention and that modifications may be made without departing from the spirit and scope of the invention as set forth in the following claims.

What is claimed is:

1. A cuffing box system operably associated with an access opening of a secured structure, comprising:

a door frame assembly comprising:

a back plate, a front plate, and a sliding door sandwiched between said back and front plates so as to be selectively movable between an open condition and a closed condition blocking the access opening;

the sliding door extending from a first edge to an opposing second edge;

the first edge providing door teeth;

a sliding door locking plate providing plate teeth, wherein the sliding door locking plate is attached to the back plate so as to be selectively movable between an unlocked disengagement and a locked engagement of said door and plate teeth; and a cuffing box providing an access frame adapted to detachably mount to the front plate, wherein the cuffing box comprises:

an enclosure communicating with the access opening, the enclosure defined on an upper portion and two opposing side portions by a transparent cover; and a transparent door pivotally movable between an open position and a closed position further defining the enclosure.

2. The cuffing box system of claim 1, further comprising:

at least one anti-tamper notch provided by the sliding door; and at least one anti-tamper bar disposed in the at least one anti-tamper notch adjacent the locked engagement.

3. The cuffing box system of claim 2, further comprising a sliding door handle extending from an upper portion of the sliding door and away from the access door.

4. The cuffing box system of claim 3, further comprising:

a latch slot provided by the front plate; and a tray top locking mechanism attached to the access frame, wherein the tray top locking mechanism provides a bolt movable between an unsecure disengagement and a secure engagement in the latch slot.

5. The cuffing box system of claim 4, wherein the sliding door handle provides a handle notch to accommodate a keyable portion of the tray top locking mechanism.

6. The cuffing box system of claim 5, further comprising:

a front plate opening provided by the front plate, wherein the front plate opening is generally coextensive with the access opening;

four pin slots along a periphery of the front plate opening;

a sliding door pin near each lower corner of the sliding door, wherein two of the four sliding door pins slide into two of the four pin slots in both the open and the closed condition, respectively.

7. The cuffing box system of claim 1, further comprising:

anti-slam door teeth providing along the second edge;

anti-slam spring plate connected to the front plate, the anti-slam spring plate providing anti-slam plate crescent teeth biased against the second edge so that when the anti-slam door crescent teeth and the anti-slam plate teeth engage, the sliding door is prevented from slamming to the closed condition.

8. The cuffing box system of claim 7, further comprising:

a first region provided by the front plate adjacent the access opening, wherein the anti-slam spring plate is disposed.

9. The cuffing box system of claim 8, further comprising:

at least one spring slot provided by the anti-slam spring plate; and a spring housed in each spring slot for biasing said anti-slam plate crescent teeth.

10. The cuffing box system of claim 9, further comprising:

at least one oversized fastener hole provided by the anti-slam plate; and a fastener connected to the back plate engaging each oversized fastener hole.

11. A cuffing box system operably associated with an access opening of a secured structure, comprising:

a door frame assembly comprising:

a back plate, a front plate, and a sliding door sandwiched between said back and front plates so as to be selectively movable between an open condition and a closed condition blocking the access opening;

a latch slot provided by the front plate;

a front plate opening provided by the front plate, wherein the front plate opening is generally coextensive with the access opening;

four pin slots along a periphery of the front plate opening;

the sliding door extending from a first edge to an opposing second edge;

a sliding door pin near each lower corner of the sliding door, wherein two of the four sliding door pins slide into two of the four pin slots in both the open and the closed condition, respectively;

the first edge providing door teeth;

a first region provided by the front plate adjacent the access opening, wherein an anti-slam spring plate is disposed;

a sliding door locking plate providing plate teeth, wherein the sliding door locking plate is attached to the back plate so as to be selectively movable between an unlocked disengagement and a locked engagement of said door and plate teeth;

a sliding door handle extending from an upper portion of the sliding door and away from the access door;

at least one anti-tamper notch provided by the sliding door;

at least one anti-tamper bar disposed in the at least one anti-tamper notch adjacent the locked engagement;

anti-slam door teeth providing along the second edge;

the anti-slam spring plate providing anti-slam plate teeth biased against the second edge so that when the anti-slam door teeth and the anti-slam plate teeth engage, the sliding door is prevented from slamming to the closed condition;

at least one spring slot provided by the anti-slam spring plate;

a spring housed in each spring slot for biasing said anti-slam plate crescent teeth;

at least one oversized fastener hole provided by the anti-slam plate; and a fastener connected to the back plate engaging each oversized fastener hole; and a cuffing box providing an access frame adapted to detachably mount to the front plate, wherein the cuffing box comprises:

an enclosure communicating with the access opening, the enclosure defined on an upper portion and two opposing side portions by a transparent cover;

a tray top locking mechanism attached to the access frame, wherein the tray top locking mechanism provides a bolt movable between an unsecure disengagement and a secure engagement in the latch slot, wherein the sliding door handle provides a handle notch to accommodate a keyable portion of the tray top locking mechanism; and a transparent door pivotally movable between an open position and a closed position further defining the enclosure.

12. A cuffing box system operably associated with an access opening of a secured structure, comprising:

a door frame assembly comprising:

a back plate, a front plate, and a sliding door sandwiched between said back and front plates so as to be selectively movable between an open condition and a closed condition blocking the access opening;

a plurality of spaced apart mounting blocks connected to the front plate; each mounting block providing a nipple-shaped mating surface; and a cuffing box comprising:

an access frame defining a box opening coextensive with the access opening; and a plurality of nipple-shaped lock tabs extending from the access frame into the box opening, each nipple-shaped lock tab spaced apart to align with one of the plurality of spaced apart mounting blocks.

13. The cuffing box system of claim 12, wherein each mounting block provides a retainer mating surface extending farther than said nipple-shaped mating surface so that when one of the plurality of nipple-shaped lock tabs operably engages said nipple-shaped mating surface said retainer mating surface opposes relative movement of said one lock tab.

14. The cuffing box system of claim 13, further comprising an enclosure communicating with the access opening, the enclosure defined on an enclosure frame covered along an upper portion and two opposing side portions by a transparent cover; and a transparent door pivotally movable between an open position and a closed position further defining the enclosure.

* * * * *